United States Patent [19]

Dissinger

[11] 3,943,679

[45] Mar. 16, 1976

[54] LOUVER PANEL ASSEMBLY

[76] Inventor: William K. Dissinger, Townhouse No. 71, Briarcrest Gardens, Hershey, Pa. 17033

[22] Filed: Sept. 23, 1974

[21] Appl. No.: 508,659

[52] U.S. Cl. ..... 52/473; 49/505; 52/475

[51] Int. Cl.[2] ..... E06B 7/08

[58] Field of Search ..... 49/171, 505, 62, 67, 75, 49/76, 70; 52/212, 716, 476, 475, 473

[56] References Cited

UNITED STATES PATENTS

| | | | |
|---|---|---|---|
| 2,860,744 | 11/1958 | Mascari | 52/212 |
| 3,303,626 | 2/1967 | Brigham | 52/475 X |
| 3,420,003 | 1/1969 | Cline | 52/212 X |
| 3,455,080 | 7/1969 | Meadows | 52/476 |
| 3,468,058 | 9/1969 | Fontaine | 49/75 |
| 3,545,135 | 12/1970 | Liebex | 49/505 |

*Primary Examiner*—Philip C. Kannan
*Attorney, Agent, or Firm*—O'Brien & Marks

[57] ABSTRACT

A louver panel assembly easily and quickly installed in a partition without the use of screws or other fasteners which require installation tools, including first and second outer frames enclosing a louver and being united by interengagable serrated portions for accomodating different size louvers in different size partitions.

5 Claims, 6 Drawing Figures

LOUVER PANEL ASSEMBLY

BACKGROUND OF THE INVENTION

1. Field of the Invention

The present invention pertains to panel assemblies and more particularly to adjustable louver panel assemblies for accomodating louvers of different thicknesses into partitions of different thicknesses without the use of installation tools.

2. Description of the Prior Art

Many louver panels are presently retained in partitions such as doors or wall by use of screws or other fasteners which unite a pair of opposed frame sections supporting a louver panel therebetween. U.S. Pat. No. 3,202,082 is typical of this type of louver panel assembly. The installation of such panels poses a problem in that a tool such as a screwdriver or the like is required, resulting in a time consuming operation, especially since a large number of screws or other fasteners are required to adequately install the assembly. The desirability of eliminating the time consuming use of installation tools is therefore quite apparent.

In addition, due to the diverse thicknesses of the various partitions encountered which are to receive the louver panel assemblies, it is desirable that any particular assembly have a wide range of adaptability with respect to these various partitions and diverse thickness louver panels be easily adaptable to diverse thickness partitions. Adjustable frames of general types exist which are adjustable to a degree because of the use of serrated interengaging members adjustably uniting a pair of frame sections during use, U.S. Pat. Nos. 3,303,626 and 3,545,135 being representative of such. Although these adaptable frames do not require screws or other fasteners and can therefore be installed quite rapidly without the use of tools, the limit of their adjustability is such that they do not solve the problem of accommodating louver panels of diverse thicknessess in partitions of diverse thicknesses.

SUMMARY OF THE INVENTION

The present invention is summarized in that a panel assembly for installation in a partition comprises a panel, first and second frame members having interengaging means therebetween for relatively positioning the frame members, and means on the first and second frame members and being relatively positionable in accordance with the degree of interengagement of the frame members for retaining the panel and partition thereby, including a first pair of opposed retainer sections, each extending from one side of a different frame member and positioned a first distance apart for a given degree of interengagement of the frame members, and a second pair of opposed retainer sections, each extending from another side of a different frame member and positioned a second distance apart for the given degree of interengagement of the frame members, with at least one of said second pair of opposed retainer sections having a flexible distal end which extends toward its mate section for accommodating different size members.

It is an object of this invention to provide a panel assembly which enables the accommodation of different thickness panels into different thickness partitions.

It is a another object of this invention to provide an adjustable louver panel assembly which is quickly and easily installed in a partition without the use of installation tools.

Further objects and advantages of the present invention will be made apparent from the following description of the preferred embodiment when taken in conjunction with the accompanying drawings.

DESCRIPTION OF THE PREFERRED EMBODIMENTS

Figure 1:
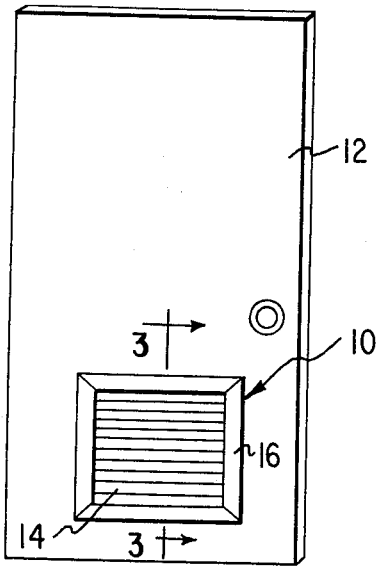
FIG. 1 is a perspective view of a partition including an installed louver panel assembly.

Referring to FIG. 1, the louver panel assembly indicated generally at 10 is commonly mounted in a partition, in this case taking the form of a door 12, for enabling ventilation therethrough in its intended manner. The louver panel assembly 10 includes an inner louver panel 14 surrounded by an outeradjustable frame assembly 16 best shown in FIGS. 2 and 3. The inner louver panel 14 includes a rectangular frame 18 supporting a plurality of louver blades 20 between two parallel sides thereof. The louver blades 20 may be fixedly bonded in position to the frame 18 resulting in a static louver panel as shown, or they may be made adjustable if desired.

Figure 6:
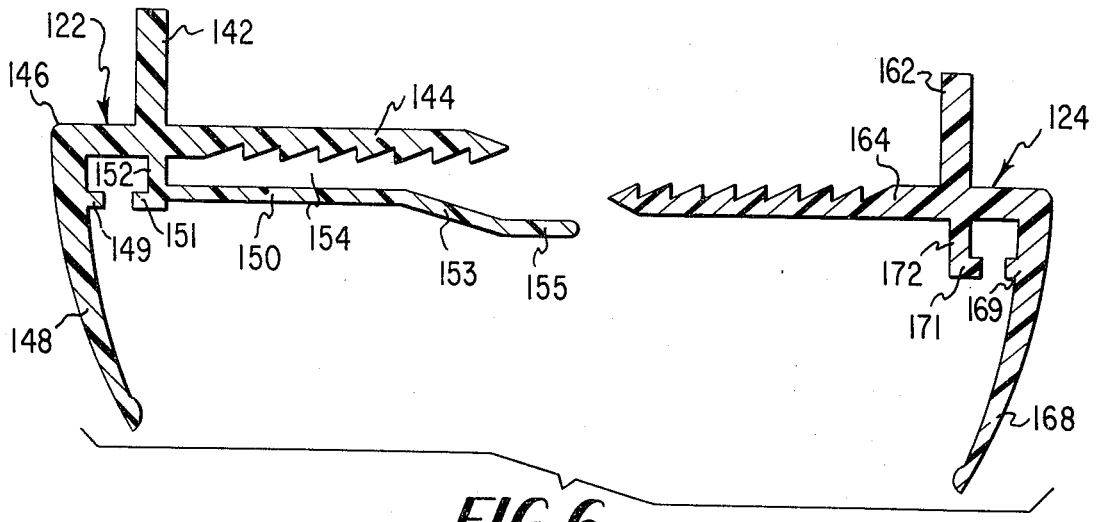
FIG. 6 is an exploded view of enlarged cross sections of louver panel frame section showing a modification of FIGS. 1–5.
Figure 4:
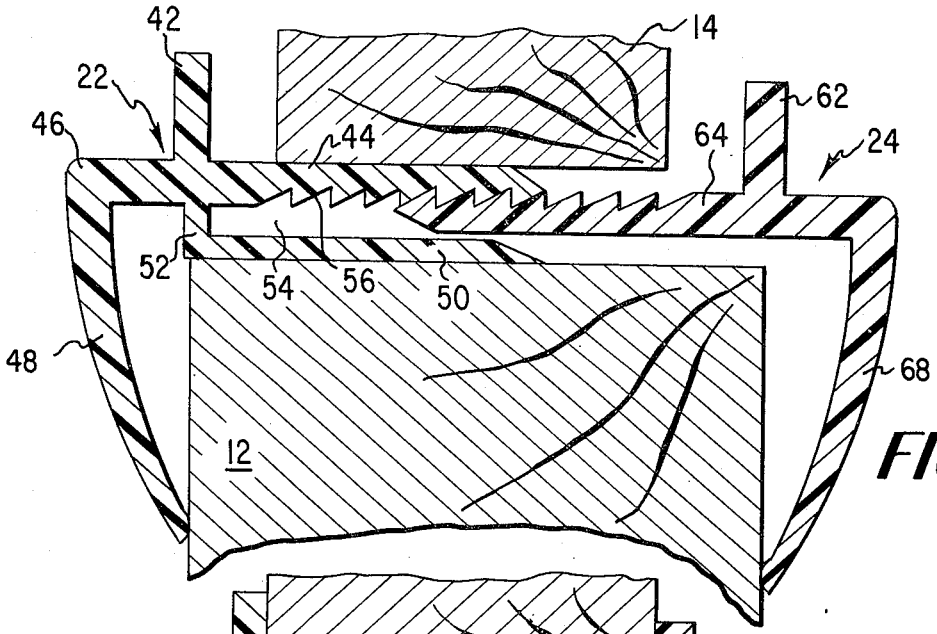
FIG. 4 is an enlarged cross section view of partially interengaged frame elements of the louver panel assembly.
Figure 5:
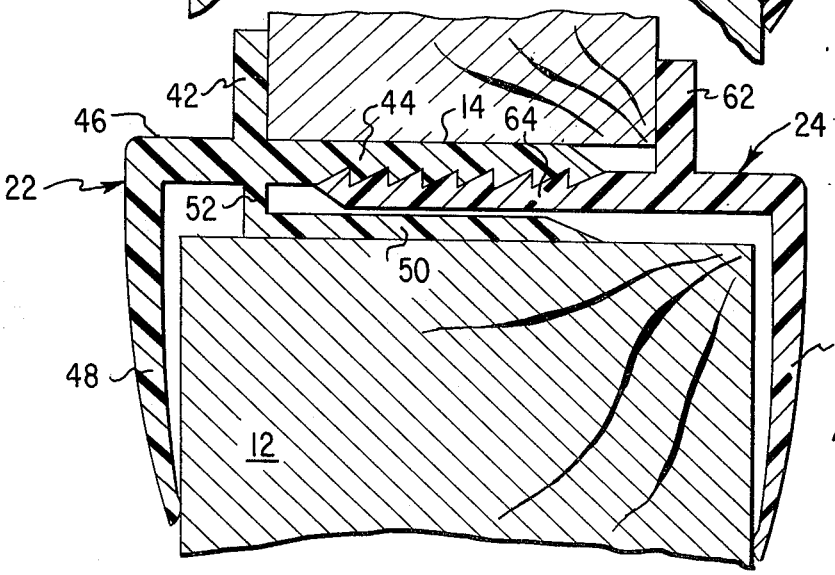
FIG. 5 is an enlarged cross section view of completely interengaged frame elements of the louver panel assembly.

The outer frame assembly 16 includes first and second rectangular mating frame sections 22 and 24 which interfit as shown in FIGS. 5 and 6 to retain the louver panel 14 therebetween. The first frame section 22 includes a sidewall or retainer flange section 42 and base 44 united at right angles to form a louver panel receiver area. A portion 46 of the base 44 extends beyond the sidewall 42 and has extending therefrom a flexible frame facer or retainer flange section 48. The frame facer 48 is wider and extends opposite to the sidewall 42 and curves inwardly toward the base 44. A backing plate 50 attached to the base 44 by an extension arm 52, extends parallel to the base 44 to form a receiver channel 54. The base 44 is provided with serrations 56 disposed along one wall of the receiving channel.

The second frame section 24 includes a sidewall or retainer flange section 62 and base 64 united to form a right angle, and a flexible facer or retainer flange section 68, wider than the sidewall 62, extending opposite to the sidewall 62 and curving inwardly toward the base 64. The base 64 has serrations on the surface adjacent the sidewall 62 for mating with the serrations 56 of the first frame section 22.

During installation of the louver panel assembly into an aperture in a partition, the louver panel 14 is retained therein by the frame sections 22 and 24 which may be loosely interengaged by partially interfitting the base 64 of the second frame section 24 into the receiver channel 54 of the first frame section 22 such that the serrations of the respective bases 44 and 64 partially interengage. An application of pressure to the first and second frame sections directed inwardly will continually increase the extent of penetration of the base 64 of the second frame section 24 into the receiver channel 54 of the first frame section such that a position, as shown in FIG. 5, will be assumed wherein the distal portions of the curved frame facers 48 and 68 abut the outer surfaces of the partition 12.

At this position, if the frame sections were completely rigid, only louver panels having a thickness equal to the distance between the sidewalls 42 and 62 would be adequately supported, but those louver panels having lesser thicknesses would tend to be loosely retained which of course is undesirable. However, the presence of the flexible curved frame facers 48 and 68 allows an additional degree of adjustability allowing the use of louver panels having such lesser thicknesses. An additional application of pressure directed inwardly against the frame sections 22 and 24 causes the base 64 to penetrate deeper into the receiver channel 54 and simultaneously flexes the curved frame facers 48 and 68 until a position is reached such that the sidewalls 42 and 62 abut the louver panel, as shown in FIG. 6 to retain it firmly in place. Due to the flexing of the frame facers 48 and 68, they are now tightly gripping the partition 12.

FIG. 6 shows a louver panel assembly similar to FIGS. 1–5 but including certain additional features as described below. FIG. 6 includes reference numerals in the 100 series for parts that are substantially the same as parts in FIGS. 1–5 while new reference numerals in the 100 series are used for new parts. Consequently, only the additional parts are being described in detail.

Figure 2:
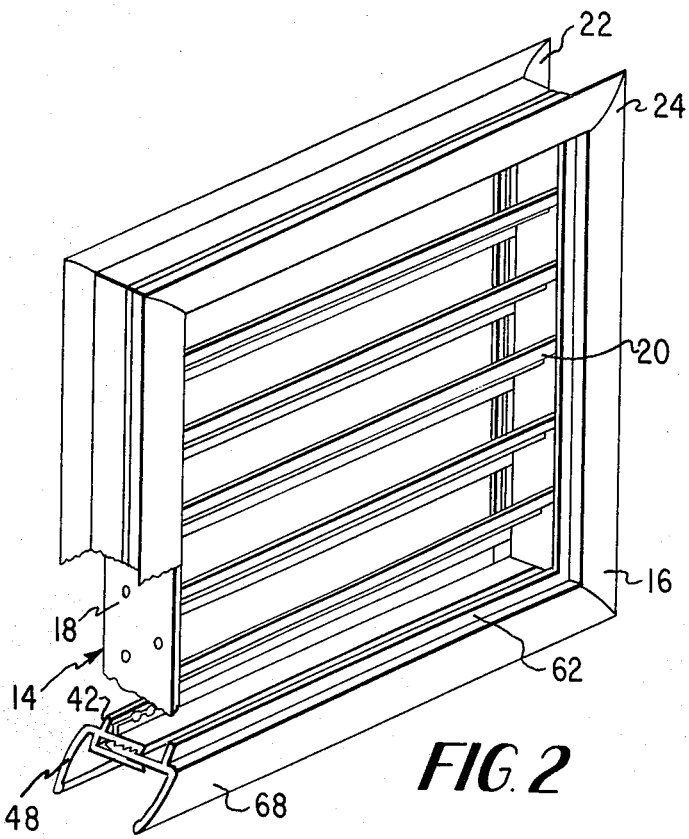
FIG. 2 is a perspective view with parts broken away, of the louver panel assembly of FIG. 1.
Figure 3:
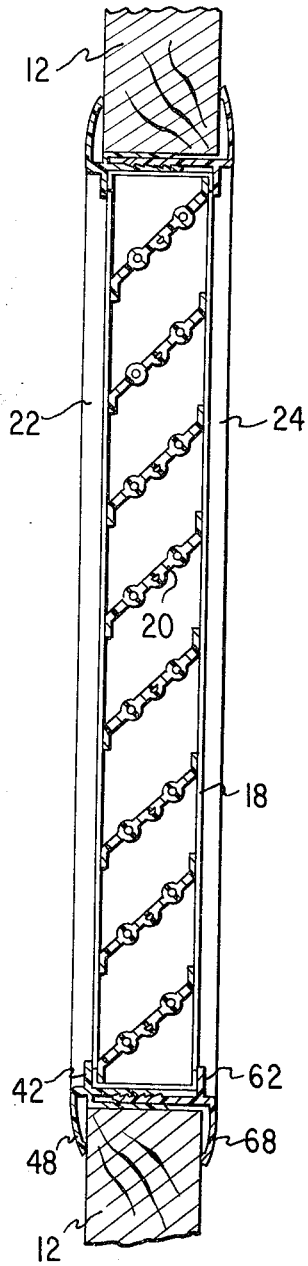
FIG. 3 is a sectional side view of the louver panel assembly.

As is shown in FIG. 6, a lug 149 (169) projects transversely from the frame facer 148 (168) toward and in spaced opposition to a similar lug 151 (157) projecting transversely from the lower edge of the extension arm 152 (172). The lugs 149 and 151 cooperate with the walls of the adjacent components to define a generally rectangular opening or slot which receives and retains an L-shaped bracket (not shown) whereby mating frame sections may be securely fastened together at a 90° angle as shown in FIG. 2. Of course, other angles than 90° may be utilized in accordance with particular installation requirements.

The backing plate 150 has its free end integrally formed with a downwardly sloping portion 153 (as viewed in FIG. 6) which defines an offsetting portion betwen the backing plate 150 and and an extremity 155 which is generally parallel thereto. During assembly, the base 164 is moved to the left as viewed in FIG. 6 and its insertion in the receiver channel 154 is facilitated because of the extremity 155 and the sloping portion 153. That is, the pointed extremity of the base 164 will slide over the backing plate extremity 155 and upwardly along the sloping portion 153 causing locking engagement between the serrations on the base 164 and the base 144.

Inasmuch as the present invention is subject to many modifications, variations and changes in detail, it is intended that all matter contained in the foregoing description or shown in the accompanying drawing shall be interpreted as illustrative and not in a limiting sense.

What is claimed is:

1. A louver panel assembly for installation in a partition comprising a louver panel having louver blades therein;

a first frame member;

a second frame member;

said first and second frame members having respective parallel elongated base portions with interengaging serrations for adjustably securing the first and second frame members together;

a first pair of opposed retainer flange sections of the respective first and second frame members extending substantially normal to the base portions inward for extending over an edge of the louver panel;

said first pair of opposed retainer flange sections being positioned a first distance apart for a given degree of interengagement of the frame members;

a second pair of opposed retainer flange sections of the respective first and second frame members extending outward from the base portions for extending over the partition;

said second pair of opposed retainer flange sections being positioned a second distance apart for the given degree of interengagement of the frame members and being substantially greater in width than the first pair of opposed retainer flange sections;

said interengaging serrations providing adjustment between the first and second frame members to secure different thicknesses of louver panels between the opposing faces of the first pair of retainer flange sections;

said second pair of opposed retainer flange sections being flexible and being curved inward at their distal edges toward each other such as to allow substantial flexing of the distal edges to accommodate for different thicknesses of partitions and to accommodate for different adjustments of the interengaging serrations; and said first and second distances being selected such that during installation both distal edges of the second pair of opposed flange sections will contact the partition before both of the first pair of retainer sections contact the louver panel.

2. The invention of claim 1 wherein the louver panel and frame members are rectangular with the frame members enclosing the periphery of the louver panel therebetween.

3. The invention of claim 1 wherein one of the frame members includes a backing member extending parallel to the base member to form a receiver cavity having the serrations therein.

4. The invention of claim 1 wherein the louver panel has a lesser thickness than the partition, and said first distance is less than said second distance.

5. The invention of claim 3 including corner bracket means and wherein said backing member includes an offset extremity to facilitate insertion of the base member of the other frame member into the receiver cavity, and wherein each first and second frame member is provided with slot means formed by lugs in the inside corner between the pair of second retaining flange sections and the respective backing member and base portion whereby adjacent frame members may be interlocked by the corner bracket means.

* * * * *